United States Patent [19]

Altman et al.

[11] 4,406,797

[45] Sep. 27, 1983

[54] FIRE EXTINGUISHANT MATERIALS

[75] Inventors: Robert L. Altman, Berkeley, Calif.; Ludwig A. Mayer; Alan C. Ling, both of San Jose, Calif.

[73] Assignee: The United States of America as represented by the Administrator of the National Aeronautics and Space Administration, Washington, D.C.

[21] Appl. No.: 317,977

[22] Filed: Nov. 3, 1981

[51] Int. Cl.[3] ..... A62D 1/00

[52] U.S. Cl. ..... 252/5; 169/47; 252/2

[58] Field of Search ..... 169/47; 252/2, 5

[56] References Cited

U.S. PATENT DOCUMENTS

| | | | |
|---|---|---|---|
| 4,149,976 | 4/1979 | Reuillon et al. | 252/5 |
| 4,194,979 | 3/1980 | Gottschall | 252/5 |

*Primary Examiner*—Leland A. Sebastian

*Attorney, Agent, or Firm*—Darrell G. Brekke; John R. Manning

[57] ABSTRACT

Fire extinguishant composition comprising a mixture of a finely divided aluminum compound and alkali metal, stannous or plumbous halide. Aluminum compound may be aluminum hydroxide, alumina or boehmite but preferably it is an alkali metal dawsonite. The metal halide may be an alkali metal, e.g. potassium iodide, bromide or chloride or stannous or plumbous iodide, bromide or chloride. Potassium iodide is preferred.

11 Claims, No Drawings

FIRE EXTINGUISHANT MATERIALS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

TECHNICAL FIELD

This invention relates to compositions of matter which are useful for extinguishing fires, more particularly fires on hot metal surfaces caused by leakage of hydrocarbon fuels such as jet fuels, and it relates also to the use of such compositions for such purposes.

BACKGROUND ART

In Altman U.S. patent application Ser. No. 178,192 filed Aug. 14, 1980, now U.S. Pat. No. 4,356,157, entitled "Synthesis of Dawsonites", a method of synthesizing dawsonites [$MAl(OH)_2CO_3$ wherein M represents an alkali metal or the ammonium radical] is described, such dawsonites having utility for extinguishing fires, more particularly fires on hot metal surfaces caused by leakage of hydrocarbon fuels such as jet fuels. Such fires occur, for example, in the nacelles of jet aircraft and it is advantageous to be able to pour a powdery, solid mixture of fire extinguishing material over the hot engine surface. It is important that the fire extinguishing effect have a sufficient duration to allow time for remedial action to be taken.

It is an object of the present invention to provide improvements in dawsonites and in other aluminum compounds such as aluminum hydroxide, boehmite and alumina for such purposes.

DISCLOSURE OF THE INVENTION

The above and other objects of the invention are accomplished by providing a mixture of such an aluminum compound, preferably dawsonite and most preferably potassium or sodium dawsonite, with a metal halide, more particularly potassium iodide.

DETAILED DESCRIPTION OF THE INVENTION

In accordance with the present invention the fire extinguishant properties of dawsonites (sodium and potassium dawsonites) and of aluminum hydroxide, alumina and boehmite are greatly improved by incorporating therein a substantial amount of metal halide. Among halides which may be so used are potassium chloride, potassium bromide, potassium iodide; their sodium analogs, namely sodium chloride, bromide and iodide; also tin and lead salts such as tin chlorides, bromides and iodides, preferably stannous salts; and also lead halides such as lead chloride, bromide and iodide, preferably the plumbous halides.

As stated, the preferred aluminum compound is an alkali metal dawsonite, preferably potassium dawsonite. This ingredient is preferably prepared by an anhydrous method such as that described in the above mentioned copending application. Briefly stated such method of preparation may be as follows:

Equimolar quantities of aluminum hydroxide, e.g. gibbsite, and an alkali metal hydrogen carbonate in the form of a dry, ground powder with a particle size smaller than 90 μm, are intimately mixed and transferred to a cylindrical open-top vessel made of aluminum or other inert metal. The vessel is placed into a high pressure reactor. The reactor is flushed with gaseous carbon dioxide and pressurized with the same gas to a level within the range of 120 to 360 psig. The reactor is then heated as quickly as possible to a temperature within the range of 150° to 250° C., and it is maintained at that temperature for a period of about 1 to 6 hours. When potassium hydrogencarbonate is used, the calcination is preferably carried out at a temperature within the range of 240° to 250° C. for about 4 to 6 hours under a carbon dioxide pressure of 230 to 250 psig. After cooling and depressurization, the product is dried in a vacuum oven at 50° C.

The proportions of aluminum ingredient (salt or oxide) and of the metal halide ingredient may vary from 25 to 99% of aluminum ingredients to 75 to 1% of metal halide. (Percentages throughout are by weight.)

In the static test a hemicylindrical stainless steel trough was employed. The under side of the trough was heated electrically, the temperature being measured by means of a thermocouple. Jet fuel (the type known as JP-4) was caused to drip continuously onto the upper surface of the trough. When a flame had developed and had reached a more or less steady state the extinguishant material, in the form of a fine powder, was applied to the flame. Meanwhile input of heat and fuel continued. Note was taken of the time before the flame rekindled.

In the flow test similar fuel was sprayed into a test section of a duct to simulate a leakage of fuel. The test section was heated externally by a propane flame. Air was caused to flow through the test section to simulate in flight conditions. Again, as in the static test, the extinguishant material was applied to the test section when the flame had reached a more or less steady state. As in the static test note was taken of the time for the flame to rekindle.

Results with the static test are set forth in Tables I and II below and results with the flow test are set forth in Table III.

TABLE 1

| INGREDIENTS | REIGNITION DELAY TIME, SECONDS | |
|---|---|---|
| | 750° C. | 900° C. |
| (1) $Al(OH)_3$ | 100 ± 30 | 3 ± 2 |
| (2) AlOOH | 48 ± 35 | NONE |
| (3) $Al_2O_3$ | 28 ± 12 | NONE |
| (4) $Al(OH)_3$ + $SnI_2$(7% I) | 204 ± 20 | 8 ± 1 |
| (5) $Al(OH)_3$ + KI (8% I) | 233 ± 56 | — |
| (6) $Al(OH)_3$ + KI (7% I) | 72 ± 3 | 8 ± 1 |
| (7) AlOOH + KI (7% I) | 131 ± 7 | 15 ± 4 |
| (8) $Al_2O_3$ + KI (7% I) | >900 | 50 ± 12 |
| | 700° C. | 900° C. |
| $SnI_2$ (68% I) | 380 ± 80 | 2 ± 2 |
| KI (76% I) | >900 | 2 ± 2 |

NOTE:
Mixtures (4) and (5) were mechanical mixtures. Mixtures (6), (7) and (8) were preheated.

TABLE II

| INGREDIENTS | REIGNITION DELAY TIME, SECONDS | | |
|---|---|---|---|
| | 700° C. | 800° C. | 900° C. |
| (1) $SnI_2$(68%) | 380 ± 80 | | 2 ± 2 |
| (2) KI(76% I) | >900 | 16 ± 6 | 2 ± 2 |
| (3) NaI(85% I) | 600 ± 60 | | 3± 2 |
| | 750° C. | | 900° C. |
| (4) $NaN(OH)_2CO_3$ | 296 ± 50 | 29 ± 5 | 6 ± 3 |

TABLE II-continued

| INGREDIENTS | REIGNITION DELAY TIME, SECONDS | |
|---|---|---|
| (5) $KAl(OH)_2CO_3$ | 153 ± 15 | 10 ± 4 |
| (6) $KAl(OH)_2CO_3$ + $SnI_2$(6% I) | 520 ± 52 | 51 ± 3 |
| (7) $KAl(OH)_2CO_3$ + $SnI_2$(6% I) | 419 ± 51 | 50 ± 2 |
| (8) $KAl(OH)_2CO_3$ + KI(7% I) | 500 ± 90 | 13 ± 4 |
| (9) $KAl(OH)_2CO_3$ + KI(7% I) | >900 | 50 ± 14 |

NOTE:
Mixtures (6) and (8) were mechanical mixtures. Mixtures (7) and (9) were preheated.

TABLE III

| | DRY CHEMICALS | GRAMS | REIGNITION DELAY TIME, sec, AT VARIOUS AIRFLOWS, mps | |
|---|---|---|---|---|
| | | | 6 | 36 |
| (1) | KCl (PYROCHEM) | 30 | <1 | 0 |
| | (SUPER-K) | 50 | — | 20 |
| (2) | KD | 30 | >20 | 0.5 |
| (3) | KD + KCl (32%) | 10-20 | 2 | >20 |
| (4) | KI | 40 | <1 | 0 |
| (5) | KD + KI (10%) | 20 | 3 | >20 |
| (6) | KD + KI (5%) | 20 | 1 | <1 |
| | | 25 | >20 | — |
| (7) | KD + KI (9%) | 15 | <1 | <20 |
| (8) | KD + KI (18%) | 20 | <1 | >20 |
| (9) | KD + $SnI_2$ (5%) | 15 | >20 | >20 |
| (10) | KD + $SnI_2$ (10%) | 15 | >20 | >20 |
| (11) | KD + $SnI_2$ (20%) | 10 | >20 | >20 |

NOTE:
Mixtures (6) to (11) were preheated.

Referring now to these tables and first to Table I, the more significant results are those set forth in the column headed 900° C., that being the temperature to which the test trough was heated. As will be seen, of the three aluminum compounds employed by themselves two resulted in no delay time in rekindling and one (aluminum hydroxide) provided a delay time of only 3±2 seconds. Results with stannous iodide and potassium iodide were similar. On the other hand, in each of the mixtures very significant improvement was noted. Thus in the case of aluminum hydroxide plus stannous iodide (7 percent iodine) the delay time was 8±1 seconds; in the case of the boehmite-potassium iodide mixture, the delay time was 15±4 seconds; and in the case of the alumina-potassium iodide mixture the delay time was 50±12 seconds.

Referring now to Table II potassium dawsonite was the chosen aluminum compound. It is apparent that mixtures of potassium dawsonite with stannous iodide and with potassium iodide performed much better than either the dawsonite alone or the iodide alone.

Referring now to Table III, it is apparent, especially at higher rates of air flow and considering the quantities of extinguishant material which were used, that mixtures of potassium dawsonite with a potassium halide or stannous iodide performed much better than the individual components.

In preparing the mixtures of the invention a simple mechanical mixing is sufficient. It is preferred that each of the ingredients be in a finely divided state, for example about 250 to 350 mesh. Inasmuch as some of the iodides are somewhat hygroscopic, it is preferred that the iodide, or the mixture of iodide and aluminum compound, be heated to drive off moisture and that the mixture be kept in a reasonably airtight container. The principal disadvantage resulting from the presence of moisture is that the product does not pour as readily. It is important in extinguishing a fire on a heated surface, such as a fire caused by leakage of jet fuel in a nacelle, that the extinguishant mixture be readily pourable so that it will spread rapidly and evenly over the burning surface.

It is therefore apparent that new and useful fire extinguishant compositions have been provided.

We claim:

1. A fire extinguishant composition comprising substantial proportions each of (a) an aluminum compound selected from the group consisting of $Al(OH_3)$, AlOOH and alkali metal dawsonites and (b) a metal halide selected from the group consisting of alkali metal, tin and lead halides.

2. The composition of claim 1 wherein components (a) and (b) are present in proportions of about 25 to 99 percent of (a) and about 75 to 1 percent of (b).

3. The composition of claim 2 wherein component (a) is an alkali metal dawsonite.

4. The composition of claim 2 wherein component (b) is an alkali metal halide.

5. The composition of claim 2 wherein component (a) is an alkali metal dawsonite and component (b) is an alkali metal halide.

6. The composition of claim 1 wherein component (a) is potassium or sodium dawsonite, component (b) is potassium iodide, and the two are present in the porportions of approximately 95 to 80 percent of the dawsonite and 50 to 20 percent of potassium iodide.

7. A method of extinguishing fires arising from leakage of fuel onto a hot solid surface, said method comprising applying to the hot, flaming surface a powdery mixture of (a) an aluminum compound selected from the group consisting of aluminum hydroxide, boehmite, alumina and an alkali metal dawsonite, and (b) a metal halide.

8. The method of claim 7 wherein components (a) and (b) are present in the mixture in the proportions of about 25 to 99 percent of (a) and about 75 to 1 percent of (b).

9. The method of claim 7 wherein component (a) is an alkali metal dawsonite.

10. The method of claim 7 wherein component (b) is an alkali metal iodide.

11. The method of claim 7 wherein the mixture is a mixture of about 80 to 95 percent of an alkali metal dawsonite and about 20 to 5 percent of potassium iodide.

* * * * *